US010219572B1

(12) United States Patent
Whitcomb

(10) Patent No.: US 10,219,572 B1
(45) Date of Patent: Mar. 5, 2019

(54) BASEBALL CAP HAVING IMPACT PROTECTION

(71) Applicant: John E. Whitcomb, Elm Grove, WI (US)

(72) Inventor: John E. Whitcomb, Elm Grove, WI (US)

( * ) Notice: Subject to any disclaimer, the term of this patent is extended or adjusted under 35 U.S.C. 154(b) by 335 days.

(21) Appl. No.: 14/799,648

(22) Filed: Jul. 15, 2015

Related U.S. Application Data

(63) Continuation-in-part of application No. 14/604,856, filed on Jan. 26, 2015, now Pat. No. 9,370,214.

(60) Provisional application No. 61/967,291, filed on Mar. 10, 2014.

(51) Int. Cl.
*A42B 3/04* (2006.01)
*A42B 3/12* (2006.01)
*A42B 1/00* (2006.01)

(52) U.S. Cl.
CPC ..... *A42B 3/121* (2013.01)

(58) Field of Classification Search
CPC ..... A42B 3/121; A42B 3/122; A42B 1/08; A42B 3/00; A42B 3/063; A42B 3/069; A42B 3/124; A42B 3/128; A42B 1/203; A42B 3/065; A42B 3/066; A42B 3/127; A63B 71/10; A63B 2102/18; A63B 60/08
See application file for complete search history.

(56) References Cited

U.S. PATENT DOCUMENTS 3,668,704 A * 6/1972 Conroy ..... A42B 3/122 2/413
3,783,450 A * 1/1974 O'Connor ..... A42B 3/28 2/421
3,872,511 A * 3/1975 Nichols ..... A42B 3/121 2/413
3,882,547 A * 5/1975 Morgan ..... A42B 3/121 2/414
3,999,220 A * 12/1976 Keltner ..... A42B 3/065 2/23
4,287,613 A * 9/1981 Schulz ..... A42B 3/145 2/413
4,354,284 A * 10/1982 Gooding ..... A42B 3/121 2/413

(Continued)

FOREIGN PATENT DOCUMENTS

WO WO 2014/186312 11/2014

*Primary Examiner* — Robert H Muromoto, Jr.
(74) *Attorney, Agent, or Firm* — Donald J. Ersler

(57) ABSTRACT

A baseball cap having impact protection includes a prior art baseball cap and an inner impact layer. The inner impact layer preferably includes at least two impact wedges. Each impact wedge matches the outer perimeter shape of one of the six wedges that make-up a cap portion of the baseball cap. Each impact wedge includes a plurality of non-bursting gas cells. Each gas cell preferably has a semi-spherical or a semi-tubular shape. The plurality of impact wedges may be permanently or removably secured to an inside surface of the baseball cap. The impact wedge includes a base sheet and an outside sheet. The outside sheet is attached to the base sheet to form the plurality of non-bursting gas cells. Alternatively, each wedge may be fabricated from closed cell foam that matches the outer perimeter shape of one of the six wedges that make-up a cap portion of the baseball cap.

10 Claims, 8 Drawing Sheets

(56) References Cited

U.S. PATENT DOCUMENTS 4,375,108 A * 3/1983 Gooding ..... A42B 3/121 2/413
4,586,200 A * 5/1986 Poon ..... A42B 3/122 2/413
4,853,980 A * 8/1989 Zarotti ..... A42B 3/285 2/413
4,912,777 A * 4/1990 Gasbarro ..... A42B 1/12 2/2.15
4,944,044 A * 7/1990 Zarotti ..... A42B 3/122 2/413
5,095,545 A * 3/1992 Lane ..... A42B 1/12 2/413
5,129,107 A * 7/1992 Lorenzo ..... A42B 1/203 2/413
5,581,818 A * 12/1996 Lorenzi ..... A42B 3/066 2/411
5,753,061 A * 5/1998 Rudy ..... A41D 31/0044 156/145
D460,604 S 7/2002 Sullivan, Jr.
8,844,066 B1 * 9/2014 Whitcomb ..... A42B 3/121 2/413
8,898,818 B1 * 12/2014 Whitcomb ..... A42B 3/122 2/413
9,173,445 B1 * 11/2015 Whitcomb ..... A42B 3/124
9,370,214 B1 * 6/2016 Whitcomb ..... A42B 3/124
2005/0204456 A1 * 9/2005 Piper ..... A42B 3/00 2/411
2006/0064801 A1 * 3/2006 Johnson ..... A41D 19/01523 2/455
2007/0192943 A1 * 8/2007 McDuff ..... A42B 3/127 2/410
2008/0250548 A1 * 10/2008 Stuhmiller ..... A41D 13/0155 2/413
2012/0036698 A1 * 2/2012 Guertin ..... A63B 63/004 29/428
2012/0131731 A1 * 5/2012 Motroni ..... A42B 1/08 2/414
2012/0192337 A1 * 8/2012 Divine ..... A42B 1/08 2/414
2012/0297526 A1 * 11/2012 Leon ..... A42B 3/12 2/413
2013/0000017 A1 * 1/2013 Szalkowski ..... F41H 1/08 2/414
2013/0111653 A1 * 5/2013 Huh ..... A42B 3/14 2/421
2013/0174331 A1 * 7/2013 Witcher ..... A42B 3/121 2/413
2013/0283504 A1 * 10/2013 Harris ..... A42B 3/069 2/411
2013/0326819 A1 * 12/2013 Wyman ..... A47C 27/15 5/738
2014/0017436 A1 * 1/2014 Vito ..... A42B 1/08 428/76
2014/0020157 A1 * 1/2014 Barr ..... A42B 3/00 2/413
2014/0173810 A1 * 6/2014 Suddaby ..... A42B 3/124 2/413
2014/0201890 A1 * 7/2014 Kelly ..... A42B 3/122 2/413
2014/0223643 A1 * 8/2014 Infusino ..... A42B 3/122 2/413
2014/0259326 A1 * 9/2014 Carlson ..... A41D 13/015 2/455
2014/0325745 A1 * 11/2014 Erb ..... A42B 3/127 2/414
2014/0342852 A1 * 11/2014 Guertin ..... A63B 71/0054 473/471
2015/0033454 A1 * 2/2015 Kelly ..... A42B 3/122 2/413
2015/0150330 A1 * 6/2015 Andrews ..... A42B 3/00 2/414
2015/0157135 A1 * 6/2015 Wyman ..... A47C 27/15 5/690
2015/0216247 A1 * 8/2015 Price ..... A42B 3/069 2/414
2015/0216249 A1 * 8/2015 Leon ..... A42B 3/12 2/412
2015/0257471 A1 * 9/2015 Warmouth ..... A42B 3/122 2/413
2015/0272255 A1 * 10/2015 Galaitsis ..... A42B 3/122 2/413
2015/0313747 A1 * 11/2015 Wanderer ..... A61F 5/08 128/205.25
2015/0327618 A1 * 11/2015 Leon ..... A42B 3/12 2/413
2015/0327619 A1 * 11/2015 Leon ..... A42B 3/12 2/413
2015/0359287 A1 * 12/2015 Witcher ..... A42B 3/121 2/413
2016/0007669 A1 * 1/2016 Harris ..... A42B 3/065 2/413
2016/0037852 A1 * 2/2016 Leon ..... A42B 3/12 2/412
2016/0044982 A1 * 2/2016 Leon ..... A42B 3/12 2/412
2016/0058092 A1 * 3/2016 Aldino ..... A42B 3/046 2/412
2016/0199721 A1 * 7/2016 Erb ..... A42B 3/127 2/414
2016/0199723 A1 * 7/2016 Rasinger ..... A63B 6/00 472/92

* cited by examiner

BASEBALL CAP HAVING IMPACT PROTECTION

BACKGROUND OF THE INVENTION

1. Cross-References to Related Applications

This is a continuation-in-part patent application, which takes priority from nonprovisional application Ser. No. 14/604,856 filed on Jan. 26, 2015, which claims the benefit of provisional application no. 61/967,291 filed On Mar. 10, 2014.

2. Field of the Invention

The present invention relates generally to head caps and more specifically to a baseball cap having impact protection, which provides a wearer protection from head bumps.

3. Discussion of the Prior Art

The purpose of protective helmets is to prevent head injury incurred during some event, such as football, ice hockey, horseback riding, skiing, lacrosse, baseball, cricket, sky diving (or any other sport using a helmet), riding a motorcycle, construction and military combat. Helmets were first invented for protection in military engagements, and as such, started as protection from hand held weapons and evolved in the $20^{th}$ Century to protect from projectiles and explosives. As such, rigid, impenetrable helmets have been the paradigm we have used for the prevention of head injuries.

Rigid helmets have been partially successful at preventing injuries. However, the recent epidemic of concussions and the increasing awareness of the cumulative problems associated with repeated head trauma have unpacked the limitations of the current structure of protective helmets in all sports. Indeed, the same limitation could be claimed for all protective helmets including construction and military helmets.

The physics of head injury is all focused on the distance over which deceleration occurs. The human brain is very fragile, being composed of cells wrapped in membranes made of fluid fatty acids. Several trillion synapses in the brain are delicately poised in proximity to one another, without rigid and strong connections. These synapses are the functional means by which the brain operates. Shaking them disrupts them. The human nervous system has developed a host of strategies to enshrine the delicate neurons and their even more delicate synapse in a protective cocoon of safety. First and foremost, the brain is floating in water (otherwise called the cerebral spinal fluid), creating a bath without rigid inflexible supports. Within that water, the brain is suspended in a delicate spider web of suspending fibers and membranes that keep water from moving too quickly around the surface and allowing the soft brain to be gently suspended within the bony structure of the skull. The skull provides a rigid structure to contain the floating bath of fluid. Of note, the skull can be cracked and shattered as one strategy of dissipating force. This may lead to survival with subsequent healing. It is a unique and delicate bony structure around the brain, not seen anywhere else in the human body. The scalp provides an additional layer of safety. It is mobile and gives when struck, providing a few extra millimeters of deceleration distance. The scalp uniquely tears when stressed by direct blows, creating yet another mechanism of safety. The tearing creates large and dramatic scalp wounds in direct head trauma, but the brain underneath survives. Finally, the human skull is surrounded by hair, which can provide another layer of cushioning.

What are the physics of deceleration injury? The formula is simple: ΔVelocity/time=Deceleration. The change in velocity is divided by time. Rigid structures striking each other have a spike of deceleration within the first 0.00001 seconds. The more rigid and brittle, the higher the G-force generated for a shorter fragment of time. The Holy Grail of injury prevention in deceleration injury is to increase the distance and therefore time during which deceleration occurs. We are familiar with automobiles and have seen the effectiveness of airbags that increase the distance of deceleration of the human torso before it strikes the steering wheel. Vehicles are also designed to crumple so that force is taken up by bending metal, collapsing frames, shattering fenders, stretching seatbelts all of which increase the distance and time over which the human inside decelerates. Each of these strategies also complements the others to have a net effect of human survival, lowing the G forces from sufficient to break bones to simple sprains, strains and bruises.

Protective helmets have, to date, failed to provide a complete cocoon of safety. If the analogy to the human head can be used, protective helmets provide a skull and the inner dura, but there is no outer layer of safety. There is no scalp. No hair. Some advances have been made with the use of external foam with the SG Helmet. The missing ingredient in foam is that it fails to "fail". The human scalp tears and gives way. Foam doesn't tear. It does provide distance for greater deceleration, resulting in reduction of concussion injuries.

It appears that the prior art does not teach or suggest the use of gas cells to create a more fluid means of slowing down deceleration and increasing the time/distance over which the deceleration occurs. The value of gas cells is that they easily deform, have little weight, stretch, deform rapidly with increasing resistance and, in extreme circumstances, burst. Bursting is a critical component, as it allows for the dissipation of force and then allows distance to increase as the next layer of cells can absorb the evolving contact. However, the essential stretching and increasing air pressure upon contact makes for a gradient of deceleration, which will provide protection. Foam deforms but is not as fluid as gas cells, has greater weight, which may result in rotational injuries of the neck. The foam cannot burst thereby dissipating energy.

U.S. Pat. No. 3,872,511 to Nichols discloses protective headgear. U.S. Pat. No. 3,999,220 to Keltner discloses air cushioned protective gear. U.S. Pat. No. 4,586,200 to Poon discloses a protective crash helmet. U.S. Pat. No. 5,129,107 discloses an inflatable safety helmet specially for motorcycling. U.S. Pat. No. 4,354,284 to Gooding discloses a protective liner for outdoor headgear. U.S. Pat. No. 5,095,545 to Lane discloses a swimming cap. Pat. No. D460,604 to Sullivan, Jr. discloses a plastic baseball cap with adjustable strap and forehead padding. Patent publication no. 2012/0131731 to Motroni discloses a baseball protective insert. Patent publication no. WO 2014/186312 to Vito et al. discloses a helmet adding system.

Accordingly, there is a clearly felt need in the art for a baseball cap having impact protection, which protects a wearer from head bumps.

SUMMARY OF THE INVENTION

The present invention provides a helmet having blunt force trauma protection, which includes a replaceable impact layer. The helmet having blunt force trauma protection (blunt force helmet) includes a prior art helmet and a replaceable impact layer. The prior art helmet may be any type of helmet, such as a football helmet, a motorcycle helmet, a bicycle helmet, a baseball helmet, lacrosse helmet or any type of protective helmet for a human head. The replaceable impact layer preferably includes at least one gas cell layer, a removable attachment system and an outer layer of sheet material. The at least one gas cell layer includes a plurality of gas cells created between two plastic sheets. The gas is preferably air, but could be any other suitable gas, such as substantially pure nitrogen or argon. Each cell will burst upon a pre-determined impact. The plurality of cells preferably have a hexagon shape, but other shapes may also be used, such as round or square. The removable attachment system is preferably hook and loop fasteners, but other suitable removable attachment systems may also be used. At least one first pad of hook and loop fasteners is attached to an exterior surface of a prior art helmet and at least one second pad of hook and loop fasteners is attached to a bottom surface of the replaceable impact layer.

A baseball cap having impact protection includes a prior art baseball cap and an inner impact layer. The inner impact layer preferably includes at least two impact wedges. Each impact wedge substantially matches the outer perimeter shape of one of the six wedges that make-up a cap portion of the baseball cap. Each impact wedge includes a plurality of non-bursting gas cells. Each gas cell preferably has either a semi-spherical or semi-tubular shape. The plurality of impact wedges may be permanently or removably secured to an inside surface of the baseball cap. The impact wedge includes a base sheet and an outside sheet. The outside sheet is attached to the base sheet to form the plurality of non-bursting gas cells. The gas is preferably air, but could be any other suitable gas, such as substantially pure nitrogen or argon. The base sheet and the outside sheet are strong enough to not burst upon impact. Alternatively, each wedge may be fabricated from a closed cell foam that substantially matches the outer perimeter shape of one of the six wedges that make-up a cap portion of the baseball cap.

Accordingly, it is an object of the present invention to provide a blunt force trauma protection, which includes an external replaceable impact layer that covers a rigid helmet and extinguishes an instantaneous G-force deceleration shock wave applied to the rigid helmet.

Finally, it is another objection of the present invention to provide a baseball cap having impact protection, which includes an inner impact layer having a plurality of impact wedges.

These and additional objects, advantages, features and benefits of the present invention will become apparent from the following specification.

DETAILED DESCRIPTION OF THE PREFERRED EMBODIMENTS

Figure 1:
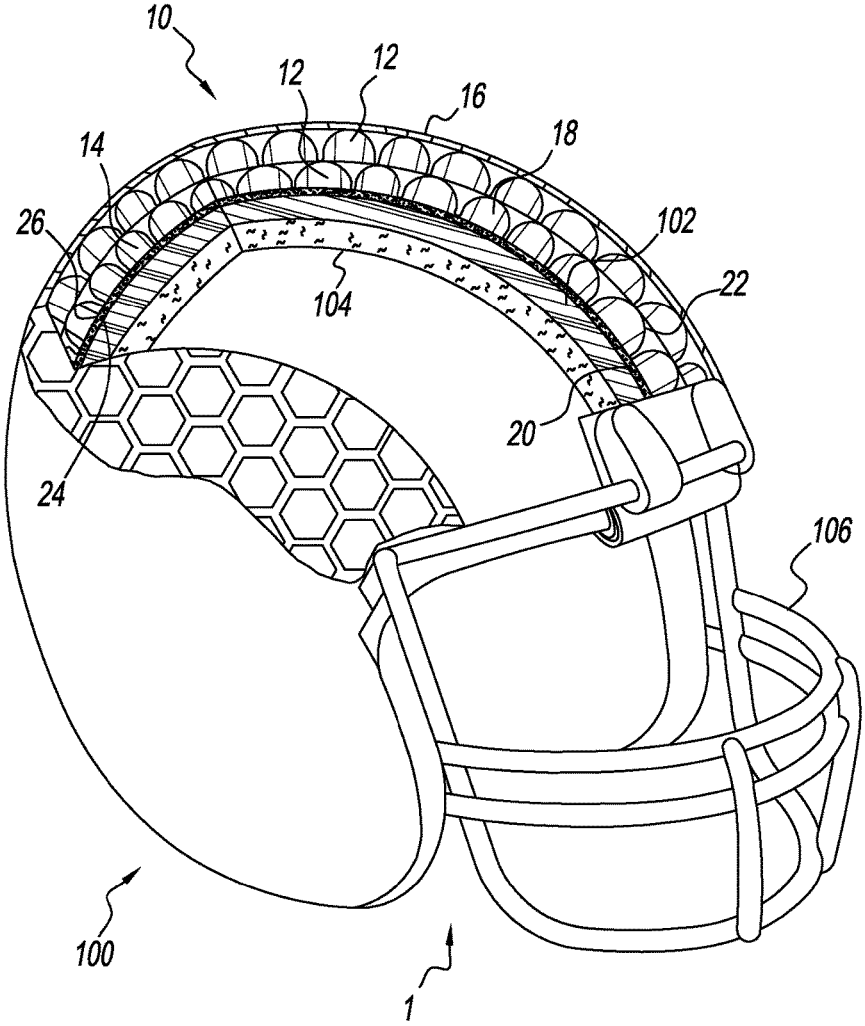
FIG. 1 is a perspective cut-away view of a blunt force football helmet with a replaceable impact layer having two gas cell layers in accordance with the present invention.
Figure 1A:
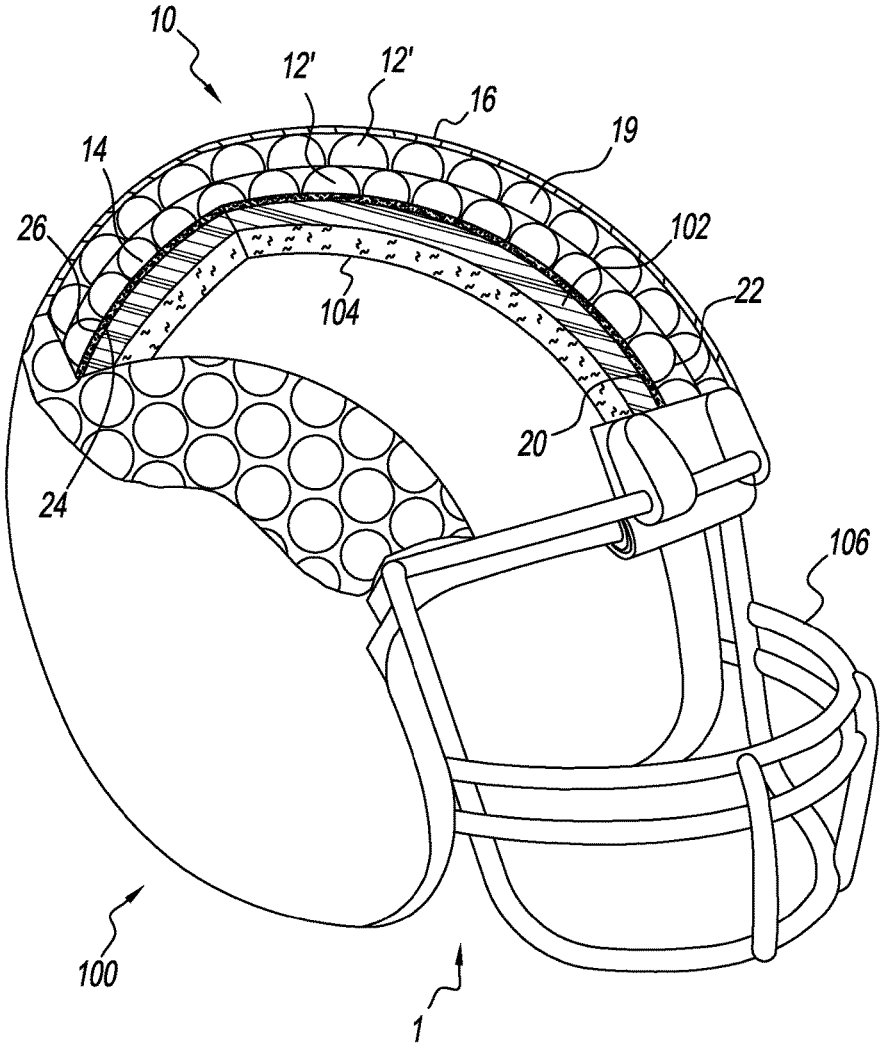
FIG. 1*a* is a perspective cut-away view of a blunt force football helmet with a replaceable impact layer having two gas cell layers with round gas cells in accordance with the present invention.
Figure 2:
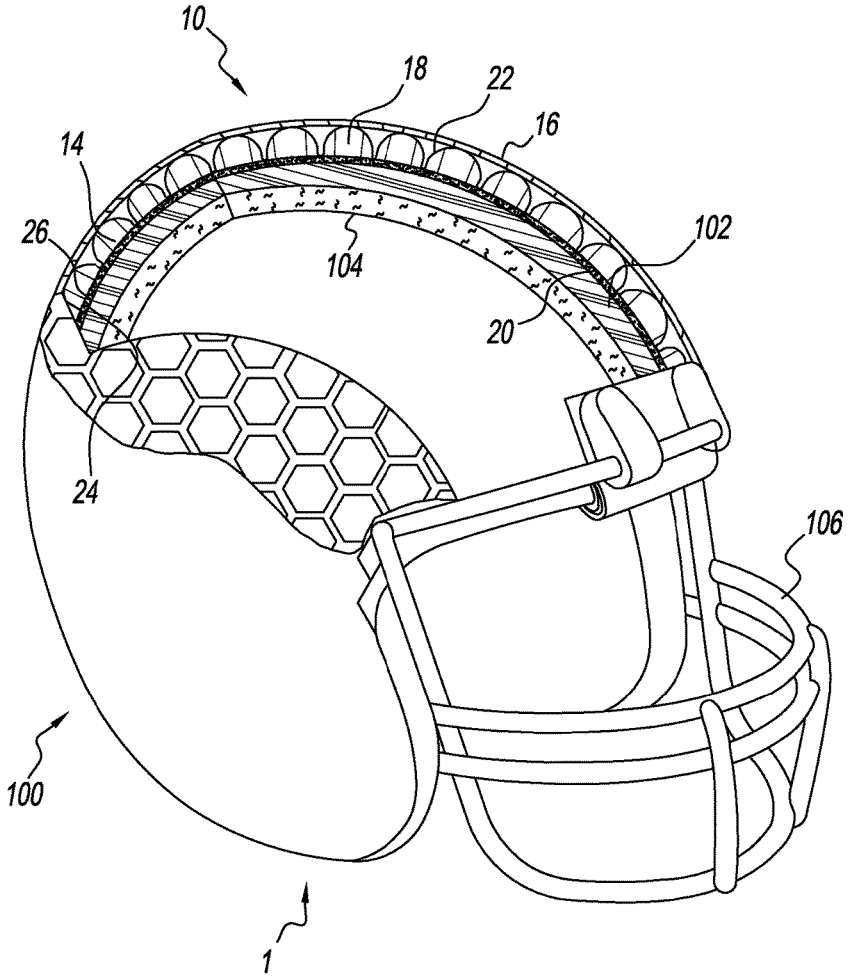
FIG. 2 is a perspective cut-away view of a blunt force football helmet with a replacement impact layer having a single a gas cell layer in accordance with the present invention.

With reference now to the drawings, and particularly to FIG. 1, there is shown a perspective cut-away view of a blunt force football helmet 1. The blunt force helmet 1 includes a prior art helmet and a replaceable impact layer 10. The prior art helmet may be any type of helmet, such as a football helmet 100, a motorcycle helmet, a bicycle helmet, a baseball helmet, lacrosse helmet or any type of protective helmet for a human head. The football helmet 100 includes a hard exterior shell 102, a padded interior 104 and a face mask 106. With reference to FIG. 2, the replaceable impact layer 10 preferably includes at least one gas cell layer 12, a removable attachment system 14 and an outer layer of sheet material 16. The at least one gas cell layer 10 includes a plurality of gas cells 18 created by a base sheet 20 and a cell sheet 22. Each of the gas cells 18 will burst upon a pre-determined impact. The gas is preferably air, but could be any other suitable gas, such as substantially pure nitrogen or argon. The following value is given by way of example and not way of limitation. It is preferably that the plurality of cells 18 burst in response to an impact of about 40 gs. The plurality of gas cells 18 preferably have a hexagon shape, but other shapes may also be used, such as round or square. FIG. 1*a* discloses two gas cell layers 12' with a plurality of gas cells 19 having a round shape. The removable attachment system 14 is preferably hook and loop fasteners, but other suitable removable attachment systems may also be used. At least one first pad 24 of hook and loop fasteners is attached to an exterior surface of the shell 102 and at least one second pad 24 of hook and loop fasteners is attached to a bottom surface of the replaceable impact layer 10. The outer layer of sheet material 16 is preferably attached to a top surface of the gas cell layer 12 with adhesive or any other suitable method.

Figure 3:
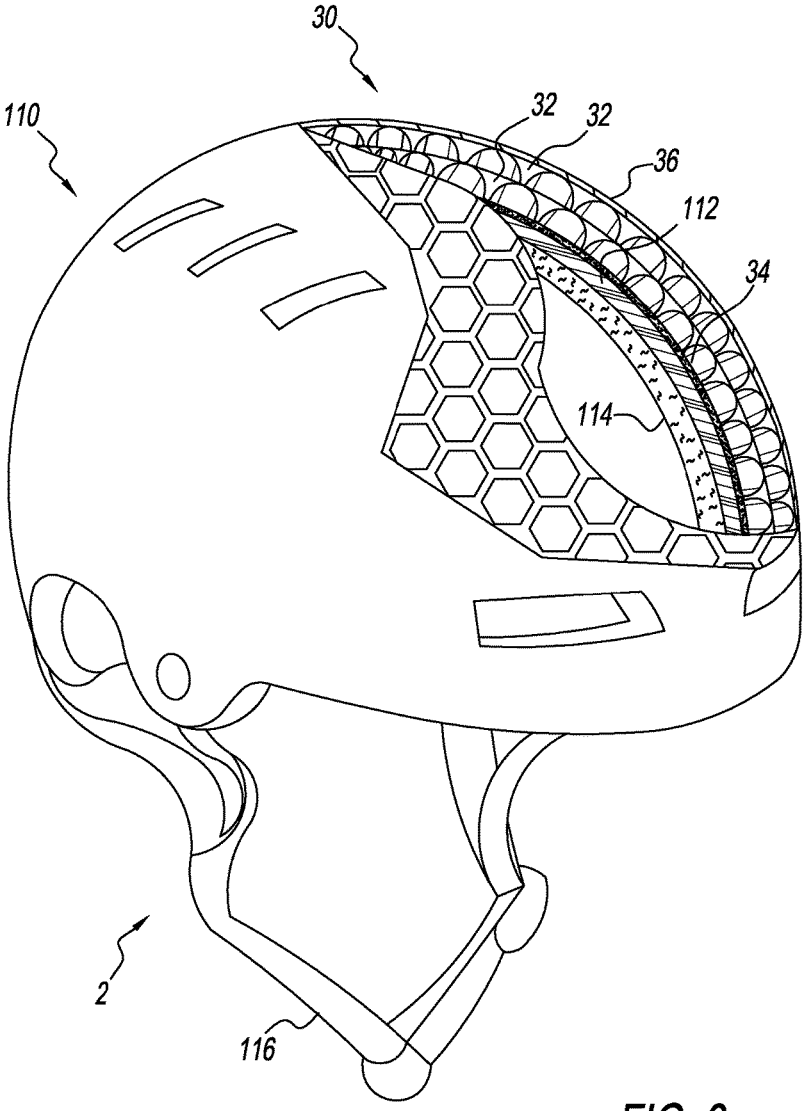
FIG. 3 is a perspective cut-away view of a blunt force bicycle helmet with a replacement impact layer having two gas cell layers in accordance with the present invention.

With reference to FIG. 3, a blunt force helmet 2 includes a bicycle helmet 110 and the replaceable impact layer 30. The bicycle helmet 110 includes a hard exterior shell 112, a padded interior 114 and a strap 116. The replaceable impact layer 30 preferably includes two gas cell layers 32, a removable attachment system 34 and an outer layer of sheet material 36. The replaceable impact layer 30 has all the features of replaceable impact layer 10. A top of a first gas cell layer 32 is attached to a bottom of a second gas cell layer 32 with adhesive or any other suitable method. The removable attachment system 34 has all the features of the replaceable impact layer 14.

The gas cells 18 on the blunt force helmets 1, 2 will burst in the area of the impact, when a force of about 40 gravitational units (40 gs) is experienced by someone wearing the blunt force helmets 1, 2. A gravitational unit is equal to 9.801 $m/s^2$. Damaged replaceable impact layers 10, 30 are removed from the blunt force helmets 1, 2 and replaced with new replaceable impact layers 10, 30. The outer layer of sheet material 16, 36 allows identification, such as team identification or advertising to be printed on an outside surface of the replacement layer 10, 30.

Figure 4:
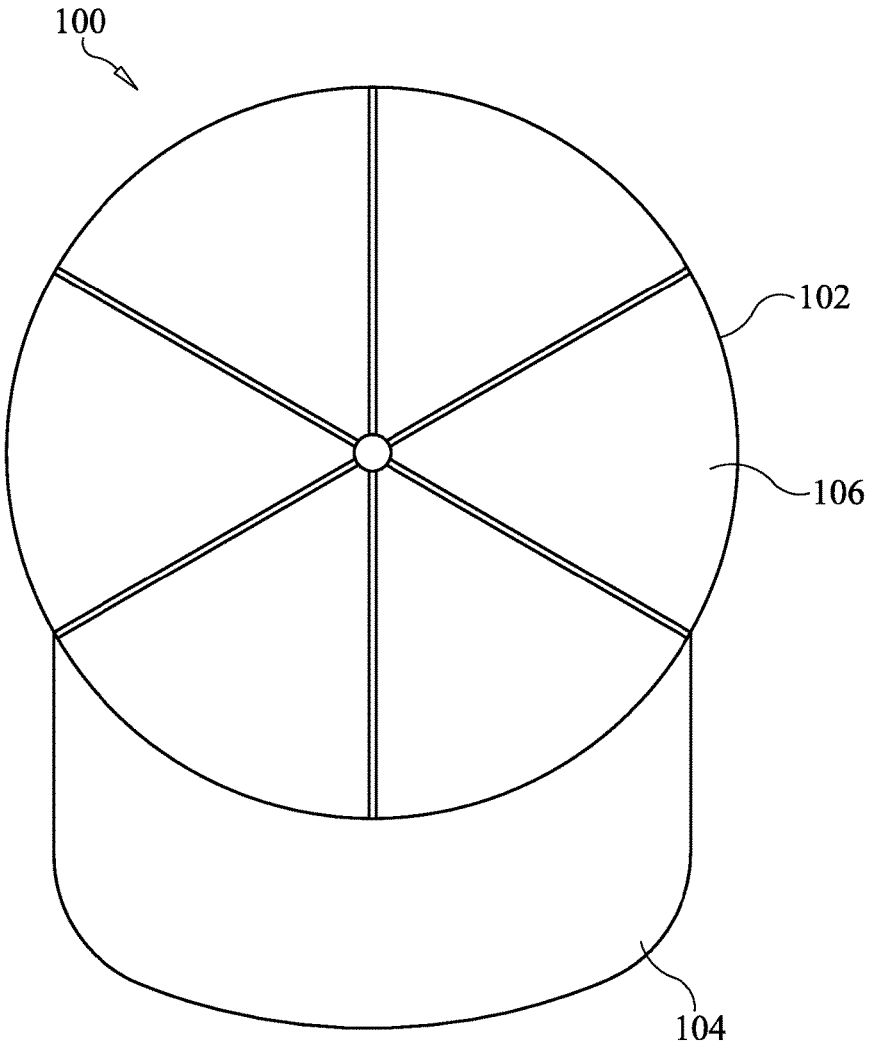
FIG. 4 is a top view of a baseball cap.
Figure 5:
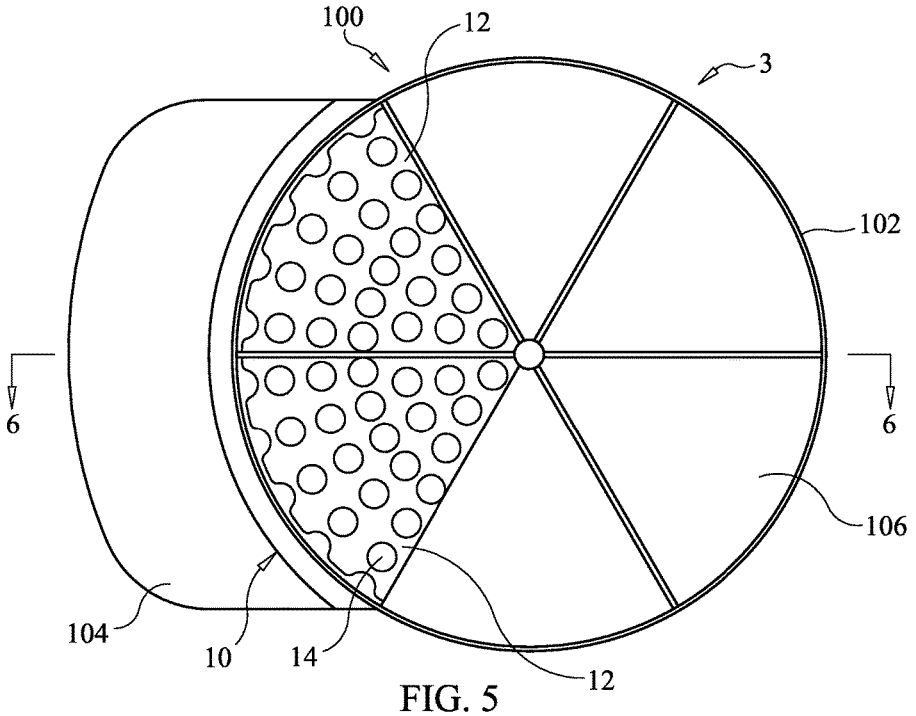
FIG. 5 is a bottom view of a baseball cap having impact protection having two impact wedges with a plurality of gas cells having a semi-spherical shape in accordance with the present intention.
Figure 6:
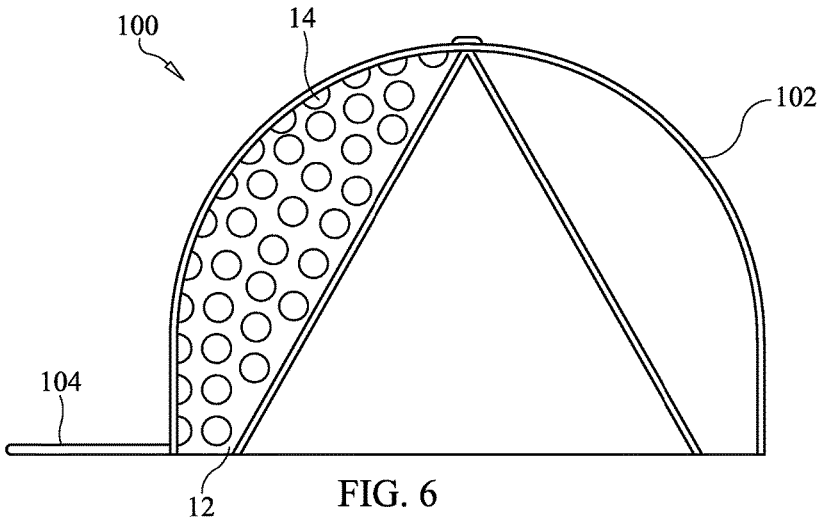
FIG. 6 is a cross sectional view of a baseball cap having impact protection having an impact wedge with a plurality of semi-spherical gas cells in accordance with the present intention.
Figure 10:
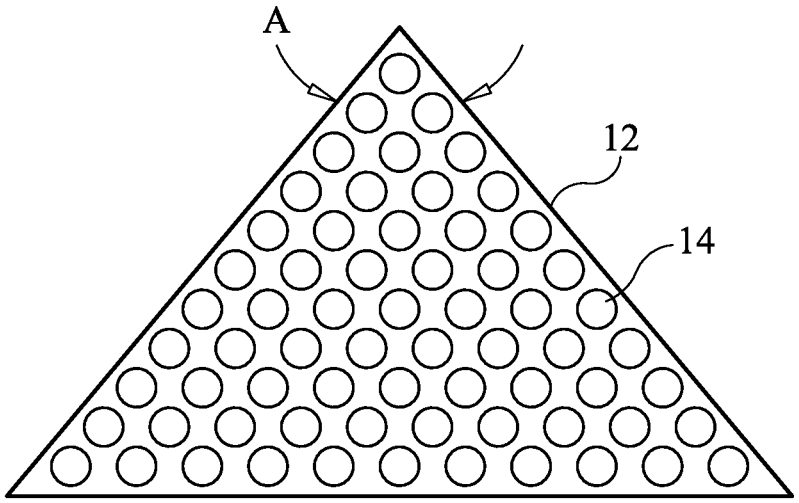
FIG. 10 is a top view of an impact wedge having a plurality of semi-spherical gas cells of a baseball cap having impact protection in accordance with the present intention.

With reference to FIGS. 4-6, a baseball cap having impact protection 3 includes a prior art baseball cap 100 and an inner impact layer 10. The baseball cap 100 includes a cap portion 102 and a visor 104. The visor 104 extends from a bottom edge of the cap portion 102. An inner surface of the cap portion 102 includes a generally concave shape. The cap portion 102 is typically constructed by joining six wedges 106 to form the substantially concave shape. The inner impact layer 10 preferably includes at least two impact wedges 12. Each impact wedge 12 matches the outer perimeter shape of one of the six wedges 106. With reference to FIG. 10, each impact wedge is substantially an equilateral triangle having an angle A at a top of about 60 degrees.

Figure 7:
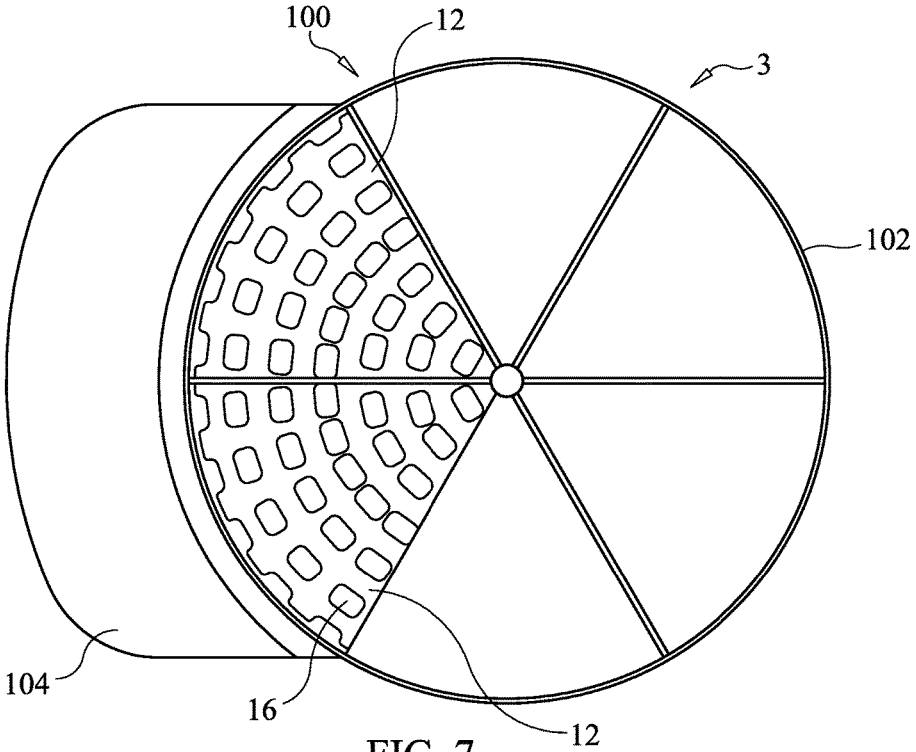
FIG. 7 is a bottom view of a baseball cap having impact protection having two impact wedges with a plurality of semi-tubular shaped gas cells in accordance with the present intention.
Figure 8:
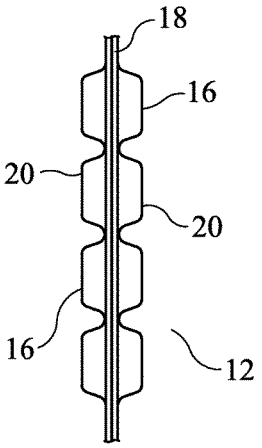
FIG. 8 is a cross-sectional view of an impact wedge having a plurality of semi-spherical gas cells of a baseball cap having impact protection in accordance with the present intention.
Figure 9:
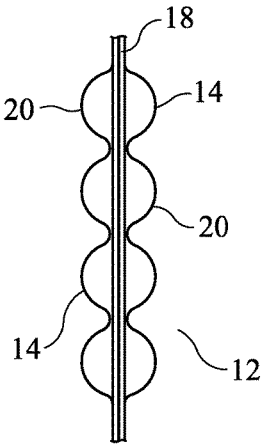
FIG. 9 is a cross-sectional view of an impact wedge having a plurality of semi-tubular gas cells of a baseball cap having impact protection in accordance with the present intention.

With reference to FIGS. 7-9, each impact wedge 12 includes a plurality of non-bursting gas cells 14, 16. Each gas cell 14, 16 has either a semi-spherical shape or semi-tubular shape, but other shapes may also be used. The plurality of impact wedges 12 may be permanently or removably secured to an inside surface of the cap portion 102 with hook and loop fasteners, adhesive or the like. The impact wedge 12 includes a base sheet 18 and an outside sheet 20. The outside sheet 20 is attached to the base sheet 20 to form the plurality of non-bursting gas cells 14, 16. The gas cells 14, 16 are preferably filled with air, but could be any other suitable gas, such as substantially pure nitrogen or argon. Two impact wedges 12 may be doubled by attaching thereof back to back as shown in FIGS. 8 and 9, or on top of one another as shown in FIG. 1. The base sheet 18 and the outside sheet 20 are strong enough that they do not burst upon impact. The impact wedge 12 must be flexible enough to be bent and formed into the curvature of an inside surface of the cap portion 100.

Figure 11:
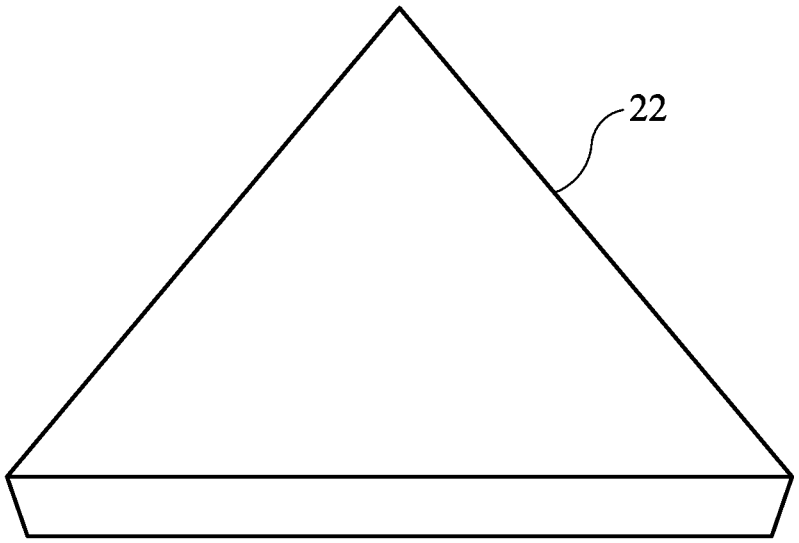
FIG. 11 is a perspective view of an impact wedge fabricated from a closed cell foam of a baseball cap having impact protection in accordance with the present intention.

With reference to FIG. 11, an impact wedge 22 may be fabricated from a closed cell foam, which matches the outer perimeter shape of one of the six wedges 106 that make-up a cap portion of the baseball cap 100. The closed cell foam has a preferable thickness of between x-y. A density of the closed cell foam is preferably between x-y. However, the closed cell foam material must also be flexible enough to be bent and formed into the curvature of an inside surface of the cap portion 100.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. Six impact wedges for attachment to an inside surface of a cap portion of a baseball cap comprising:

six impact wedges each include a base sheet and an outside sheet, said outside sheet is attached to said base sheet to form a plurality of non-bursting gas cells, said plurality of non-bursting gas cells are substantially equal in size, said plurality of bursting gas cells do not communicate with each other by allowing a flow of gas between adjacent cells of said plurality of non-bursting gas cells, each one of said six impact wedges includes an outer perimeter shape that is substantially an equilateral triangle, wherein said six impact wedges are flexible such that thereof are capable of being bent to form a curvature of an inside surface of a cap portion of a baseball cap, a corner of each of said six impact wedges are positioned adjacent to each other at a top of the inside surface of the baseball cap, said six impact wedges cover substantially all of the inside surface of the cap portion.

2. The six impact wedges for attachment to an inside surface of a cap portion of a baseball cap of claim 1 wherein:

said plurality of non-bursting gas cells are filled with one of air, pure nitrogen and argon.

3. The six impact wedges for attachment to an inside surface of a cap portion of a baseball cap of claim 1 wherein:

said plurality of non-bursting gas cells having one of a semi-spherical shape and a semi-tubular shape.

4. The six impact wedges for attachment to an inside surface of a cap portion of a baseball cap of claim 1 wherein:

said impact wedge is permanently or removably attached to said inside surface of said cap portion.

5. A baseball cap having impact protection comprising:

a baseball cap includes a cap portion and a visor, said visor extends from a bottom edge of said cap portion, said cap portion includes a concave surface;

six impact wedges each include a base sheet and an outside sheet, said outside sheet is attached to said base sheet to form a plurality of non-bursting gas cells, said plurality of non-bursting gas cells are substantially equal in size, said plurality of bursting gas cells do not communicate with each other by allowing a flow of gas between adjacent cells of said plurality of non-bursting cells, each one of said six impact wedges include an outer perimeter shape that is substantially an equilateral triangle, two sides of each of said six impact wedges contacts a side of two adjacent impact wedges of said six impact wedges, wherein said impact wedge is flexible such that thereof is capable of being formed for attachment to said concave surface of said cap portion, a corner of each of said six impact wedges are positioned adjacent to each other at a top of the inside surface of the baseball cap, said six impact wedges cover substantially all of the inside surface of the cap portion.

6. The baseball cap having impact protection of claim 5 wherein:

said plurality of non-bursting gas cells are filled with one of air, pure nitrogen and argon.

7. The baseball cap having impact protection of claim 5 wherein:

said plurality of non-bursting gas cells having one of a semi-spherical shape and a semi-tubular shape.

8. The baseball cap having impact protection of claim 5 wherein:

said impact wedge is permanently or removably attached to said inside surface of said cap portion.

9. At least one impact wedge for attachment to an inside surface of a baseball cap comprising:

six impact wedges each fabricated from a closed cell foam, each one of said six impact wedges includes an outer perimeter shape that is substantially an equilateral triangle, wherein said six impact wedges are flexible such that thereof are capable of being bent to form a curvature of an inside surface of a cap portion of a baseball cap, a corner of each of said six impact wedges are positioned adjacent to each other at a top of the inside surface of the baseball cap, said six impact wedges cover substantially all of the inside surface of the cap portion.

10. The at least one impact wedge for attachment to an inside surface of a baseball cap of claim 9 wherein:

said impact wedge is permanently or removably attached to said inside surface of said cap portion.

* * * * *